US005304890A

United States Patent [19]

Tsukui et al.

[11] Patent Number: 5,304,890

[45] Date of Patent: Apr. 19, 1994

[54] CATHODE RAY TUBE DEVICE HAVING REINFORCING FRAME

[75] Inventors: Keitaro Tsukui; Junko Itoh; Kenichi Umino, all of Amagasaki; Kouji Nakamura; Tesshin Yazu, both of Nagaokakyo, all of Japan

[73] Assignee: Mitsubishi Denki Kabushiki Kaisha, Tokyo, Japan

[21] Appl. No.: 815,188

[22] Filed: Dec. 31, 1991

[30] Foreign Application Priority Data

| | | | |
|---|---|---|---|
| Jan. 16, 1991 | [JP] | Japan | 3-003276 |
| Jun. 24, 1991 | [JP] | Japan | 3-151727 |
| Sep. 24, 1991 | [JP] | Japan | 3-243002 |

[51] Int. Cl.[5] ..... H01J 29/86; H01J 29/87

[52] U.S. Cl. ..... 313/477 R; 220/2.1 A; 348/822

[58] Field of Search ..... 313/477 R, 482, 479; 358/245, 246; 220/2.3 A, 2.1 A

[56] References Cited

U.S. PATENT DOCUMENTS

| | | | |
|---|---|---|---|
| 2,132,783 | 10/1938 | Goldmark | 313/477 X |
| 2,222,197 | 11/1940 | Engels | 313/477 |
| 2,635,205 | 4/1953 | Olson | 313/477 X |
| 2,866,187 | 12/1958 | Fisch . | |
| 3,248,480 | 4/1966 | Browning et al. | 358/246 |
| 4,016,364 | 4/1977 | Rogers . | |
| 4,054,913 | 10/1977 | Lerner . | |
| 4,432,464 | 2/1984 | Seats et al. | 220/2.1 A |
| 4,522,309 | 6/1985 | Overall et al. | 220/2.1 A |
| 4,720,657 | 1/1988 | Tischer | 313/497 |
| 4,990,825 | 2/1991 | Tsukui et al. . | |

FOREIGN PATENT DOCUMENTS

| | | |
|---|---|---|
| 975461 | 7/1949 | Fed. Rep. of Germany . |
| 933404 | 9/1955 | Fed. Rep. of Germany . |
| 1858661 | 12/1961 | Fed. Rep. of Germany . |
| 586797 | 8/1944 | United Kingdom . |
| 786640 | 10/1954 | United Kingdom . |

*Primary Examiner*—Sandra L. O'Shea

[57] ABSTRACT

A cathode ray tube has a metal funnel welded to a metal skirt. The skirt is reinforced to resist tensile stress. Reinforcement is accomplished by thickening the skirt, or corner portions thereof; by welding one or more reinforcing members to the inside or outside of the skirt; by bending the edges of the skirt and funnel and welding the bent parts together; by welding reinforcing plates to corners of the skirt and winding a tension band around the skirt; or by providing a rigid frame with compression members to press inward on the skirt.

33 Claims, 9 Drawing Sheets

CATHODE RAY TUBE DEVICE HAVING REINFORCING FRAME

BACKGROUND OF THE INVENTION

The present invention relates to a cathode ray tube device (hereinafter abbreviated as CRT), for picture display in a TV set or the like.

FIG. 1 is a lateral view of a conventional CRT, the upper part being shown in section. The front of this CRT (which is at the left side of FIG. 1) comprises a panel 1. Panel 1, a funnel 2, connected to the rear part of panel 1, and a neck (not shown in the drawing) installed at the rear of funnel 2, form the main construction. Panel 1 comprises a faceplate 1*a* and skirt 1*b*, skirt 1*b* being connected to the peripheral edges of faceplate 1*a*. Panel 1 and funnel 2 are made of glass, and are glass-soldered together with frit glass. A metal tension band 3, is wound around skirt 1*b*. The interior of the CRT is evacuated, atmospheric pressure tends to press the middle part of faceplate 1*a* and funnel 2 inward, causing skirt 1*b* to bulge slightly toward the outside. Referring to FIG. 2, the middle part of panel 1 and funnel 2 are subjected to compressive stress, while tensile stress occurs in the neighborhood of skirt 1*b*.

FIG. 3 an oblique view of part of the CRT in FIG. 1. Cross-hatching in FIG. 3 shows where tensile stress occurs. In general glass is strong in resisting compressive stress but relative weak in resisting tensile stress, causing the CRT to be susceptible to implosion. The skirt 1*b*, faceplate 1*a*, and funnel 2 have therefor been made of, thick glass. Conventional CRTs, especially the larger types, require an extremely thick skirt 1*b*, faceplate 1*a* and funnel 2 making the total weight of the CRT inconveniently heavy.

SUMMARY OF THE INVENTION

An object of the invention is to provide a lightweight CRT that is effectively protected against implosion.

A CRT according to one aspect of the invention comprises, a glass faceplate forming an image display surface, a frame-shaped metal skirt connected to the outer periphery of the faceplate, a funnel having one end connected to the skirt and forming a side wall, a neck connected to another end of the funnel, an electron gun disposed in the neck facing the faceplate. In this case the the skirt is formed thicker than the funnel thus increasing the mechanical strength of the the skirt, which is exposed to tensile stress. The thinness of the funnel reduces the total weight of the CRT.

A CRT according to another aspect of the invention comprises, a glass faceplate forming an image display surface, a frame-shaped metal skirt connected to the outer periphery of the faceplate, a funnel having one end connected to the skirt and forming a side wall, a neck connected to another end of the funnel, an electron gun disposed in the neck facing the faceplate. To the skirt a rigid reinforcing member is attached. In this case, the skirt is strengthened by the rigid reinforcing member, thus reducing the risk of implosion.

A CRT according to yet another aspect of the invention comprises, a glass faceplate forming an image display surface, a frame-shaped metal skirt connected to the outer periphery of the faceplate, a funnel having one end connected to the skirt and forming a side wall, a neck connected to another end of the funnel, an electron gun disposed in the neck facing the faceplate. The edge of the skirt facing the funnel is bent, forming a bent part. The edge of the funnel facing the skirt is also bent, forming a bent part. The bent of the skirt and the bent part of the funnel are welded together. The bent parts of the funnel and the skirt greatly increase the mechanical strength of the skirt.

A CRT according to still another aspect of the invention comprises, a glass faceplate forming an image display surface, a frame-shaped metal skirt connected to the outer periphery of the faceplate, a funnel having one end connected to the skirt and forming a side wall, a neck connected to another end of the funnel, an electron gun disposed in the neck facing the faceplate. The corner parts of the skirt are thickened. A tension band is wound around the skirt, passing over the thickened corner portions. The tension band resist tensile stress, and reinforcing the corners of the skirt provides extra strength at the portions of greatest stress.

A CRT according to another aspect of the invention comprises, a glass faceplate forming an image display surface, a frame-shaped metal skirt connected to the outer periphery of the faceplate, a funnel having one end connected to the skirt and forming a side wall, a neck connected to another end of the funnel, an electron gun disposed in the neck facing the faceplate. Rigid reinforcing plates are welded to the corners of the skirt, and a tension band is wound around the skirt. In this case the mechanical strength of the skirt has increased because of the tension band and the rigid reinforcing plates.

A CRT according to still another aspect of the invention comprises, a glass faceplate forming an image display surface, a frame shaped metal skirt connected to the outer periphery of the faceplate, a funnel having one end connected to the skirt and forming a side wall, a neck connected to another end of the funnel, an electron gun disposed in the neck facing the faceplate. A rigid reinforcing frame is surrounding the skirt and a plurality of compression members (such as screws or springs) attached to the rigid reinforcing frame are pressing inwardly on the skirt. The compression members provide increased resistance to tensile stress

DETAILED DESCRIPTION OF THE PREFERRED EMBODIMENTS

Figure 1:
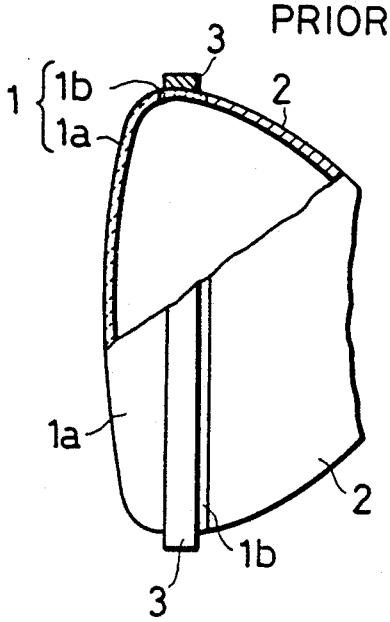
FIG. 1 PRIOR ART
FIG. 1 is a partial sectional side view of a conventional CRT.
Figure 2:
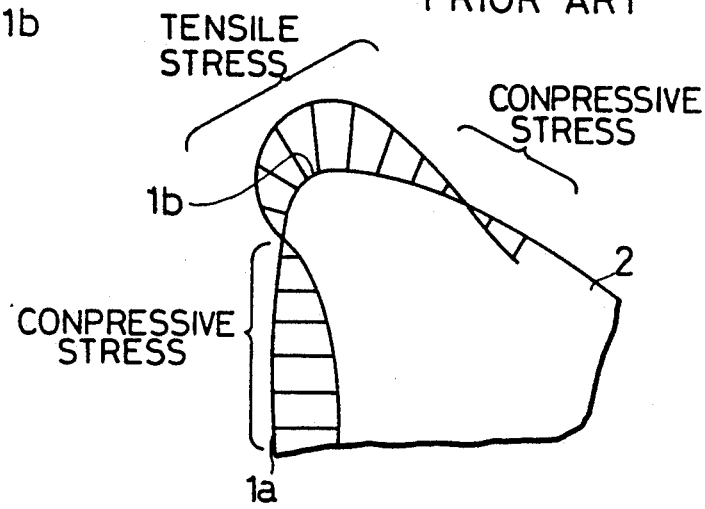
FIG. 2 PRIOR ART
FIG. 2 illustrates the distribution of stress on the CRT of FIG. 1.
Figure 3:
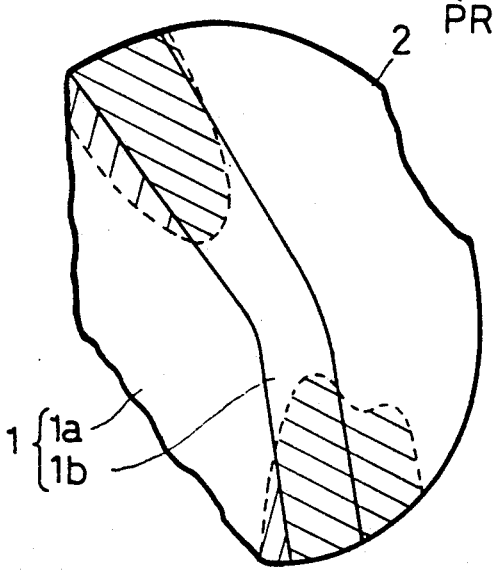
FIG. 3 PRIOR ART
FIG. 3 is an oblique view of the CRT of FIG. 1.
Figure 4:
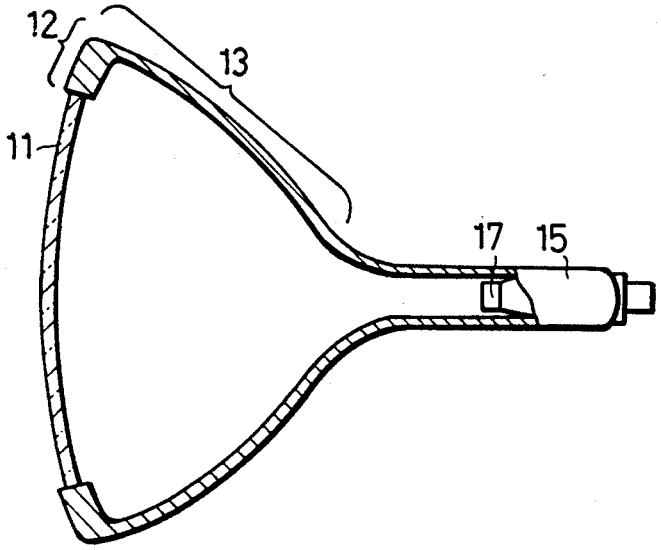
FIG. 4 is a partial sectional view of one form of a first embodiment of the present invention.

FIG. 4 shows a sectional view of a CRT according to a first embodiment of the invention. This CRT comprises a rectangular glass faceplate 11 for picture display, a frame-shaped metal skirt 12 joined to the peripheral edge of faceplate 11, and a metal funnel 13 joined to skirt 12 and forming a side wall. In this CRT, skirt 12 and funnel 13 are made of the same material and formed as a single body. Skirt 12 has an L-shaped cross section and resembles a picture frame if viewed from the front (from the left side of the drawing). Faceplate 11 and skirt 12 are joined by glass soldering using frit glass or brazing. Faceplate 11 is made of a glass material such as the H8602 material specified by the Electronic Industries Association of Japan. The thermal expansion coefficient of the glass faceplate 11 should be close to the thermal expansion coefficient of skirt 12 and funnel 13, which are made of a type steel such as SUS430 having a very low rate of outgassing in a vacuum. The surfaces of skirt 12 and funnel 13 are comprised coated with an insulating material (not shown in this drawing). At the end distant from faceplate 11, funnel 13 terminates in a neck 15 containing an electron gun 17. Skirt 12 of this CRT is everywhere thicker than funnel 13. The mechanical strength of skirt 12 is therefor considerably increased, thus protecting the CRT against from an implosion. Because of the thickness of skirt 12, it is possible for funnel 13 to be comparatively thin resulting in a lightweight CRT.

Figure 5:
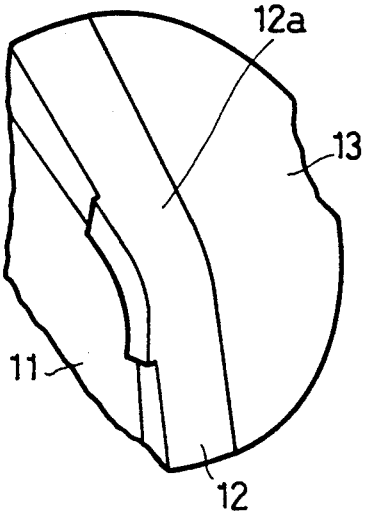
FIG. 5 is a partial oblique view of another form of the first embodiment.

FIG. 5 is a partial oblique view of the upper part of another CRT. Elements in FIG. 5 corresponding to elements in FIG. 4 have the same reference numerals. In this CRT, skirt 12 and funnel 13 are formed separately, then welded together. This figure differs from FIG. 4 in that only the corner parts 12*a* of skirt 12 are thicker than funnel 13. The CRT of FIG. 5 is inferior to the one in FIG. 4 in mechanical strength, but lighter in weight.

Figure 6:
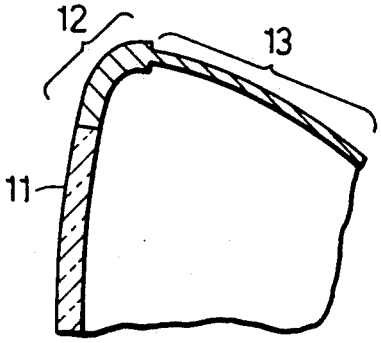
FIG. 6 is a partial sectional view of still another form of the first embodiment.

FIG. 6 is a sectional view of the upper front part of another CRT. Elements in FIG. 6 corresponding to elements in FIG. 4 have the same reference numerals. In this CRT, skirt 12 and funnel 13 are made of the same material and formed as a single body. Although skirt 12 is thicker than funnel 13, skirt 12 is of the same thickness as faceplate 11, funnel 13 being thinner than skirt 12. The mechanical strength of skirt 12 tends to prevent implosion, while the thinness of funnel 13 gives a lighter CRT.

Figure 7:
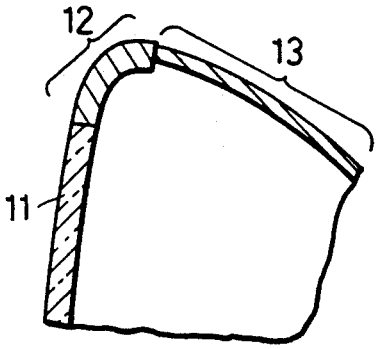
FIG. 7 is a partial sectional view of yet another form of the first embodiment.

FIG. 7 is a sectional view of the front upper part of yet another CRT. Elements in FIG. 7 corresponding to elements in FIG. 6 have the same reference numerals. In this CRT, skirt 12 and funnel 13 are formed separately, then welded together. Except for this difference, the CRT in FIG. 7 is the same as in FIG. 6. Manufacturing the CRT in FIG. 7 requires an extra welding process, but since it is not necessary to change the thickness, the processes of manufacturing skirt 12 and funnel 13 are simpler than the manufacturing process required in FIGS. 4 to 6.

Figure 8A:
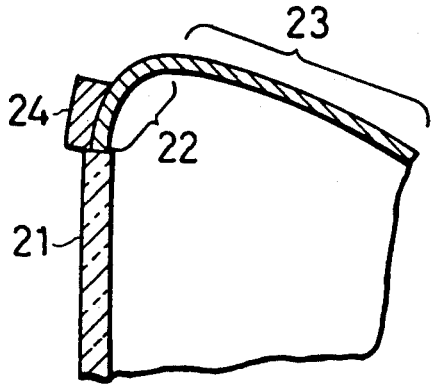
FIG. 8A is a sectional view of one form of a second embodiment of the present invention.
Figure 8B:
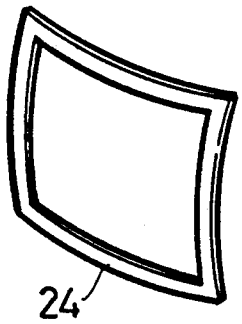
FIG. 8B is an oblique view of the reinforcing device.

FIG. 8A is a sectional view of the front upper part of a CRT according to a second embodiment. This CRT comprises a rectangular glass faceplate 21 for picture display, a frame-shaped metal skirt 22 joined to the edge of faceplate 21, and a metal funnel 23 joined to skirt 12 and forming a side wall. In this CRT, skirt 22 and funnel 23 are made of the same material and formed as a single body. Skirt 22 has an L-shaped cross section and resembles a picture frame if viewed from the front (from the left side of the drawing). Faceplate 21 and skirt 22 are joined by glass soldering using frit glass. The surfaces of skirt 22 and funnel 23 are coated with an insulating material (not shown in this drawing). At the end distant from faceplate 21, funnel 23 terminates in a neck (not shown) containing an electron gun (not shown). A reinforcing member 24 of high rigidity is welded to the outside of skirt 22. Since skirt 22, the part in which tensile stress occurs is strengthened by reinforcing frame 24, the part is protected from implosion, furthermore, since funnel 23 is not subject to tensile stress it can be made thin, decreasing the total weight of the CRT.

Figure 9:
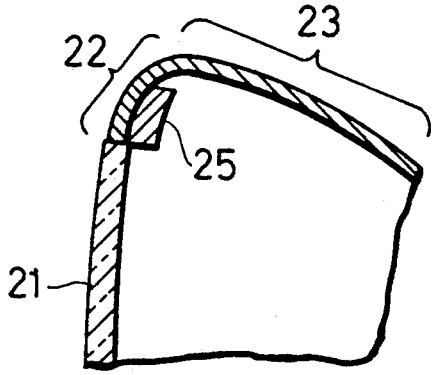
FIG. 9 is a partial sectional view of yet another form of the second embodiment.

FIG. 9 is a sectional view of the upper front part of another CRT. Elements in FIG. 9 corresponding to elements in FIG. 8A have the same reference numerals. In this CRT, skirt 22 and funnel 23 are made of the same material and formed as a single body. In FIG. 9, a metal reinforcing frame 25 with high rigidity is welded to the inside of skirt 22. Since skirt 22, the part in which tensile stress occurs, is strengthened by reinforcing frame 25, the part is protected from implosion. Furthermore, since funnel 23 is not subject to tensile stress it can be made thin, decreasing the total weight of the CRT.

Figure 10A:
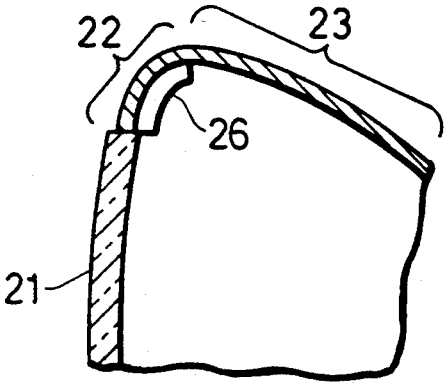
FIG. 10A is a partial sectional view of still another form of the second embodiment.
Figure 10B:
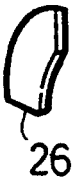
FIG. 10B is an oblique view of a rib.

FIG. 10A is a sectional view of the upper front part of another CRT. Elements in FIG. 10A corresponding to elements in FIG. 8A have the same reference numerals. In this CRT, skirt 22 and funnel 23 are made of the same material and formed as a single body. The reinforcement in FIG. 10A is a plurality of crosswise ribs 26 (only one of which is shown in FIG. 10A) welded to the inside of skirt 22. The ribs 26 are disposed in directions orthogonal to the circumference of faceplate 21, and are spaced at certain intervals around faceplate 21. FIG. 10B shows the shape of one of the ribs 26. Since skirt 22, the part in which tensile stress occurs is strengthened by reinforcing ribs 26, the part is protected from implosion, furthermore, since funnel 23 is not subject to tensile stress it can be made thin, decreasing the total weight of the CRT.

Figure 11:
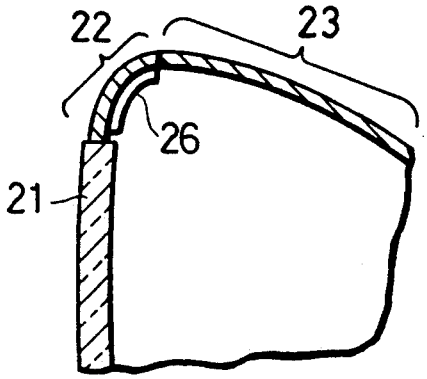
FIG. 11 is a partial sectional view of yet another form of the second embodiment.

FIG. 11 is a sectional view of the upper front part of another CRT. Elements in FIG. 11 corresponding to elements in FIG. 10A have the same reference numerals. In this CRT, skirt 22 and funnel 23 are formed separately, then welded together. Except for this difference the CRT of FIG. 11 is the same as FIG. 10A.

Figure 12A:
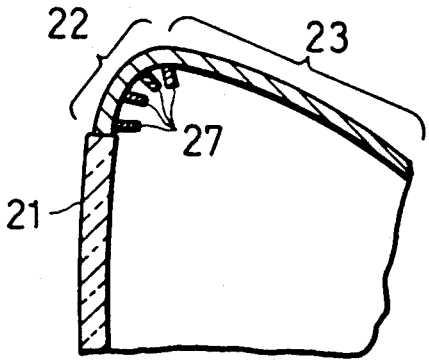
FIG. 12A is partial sectional view of yet another form of the second embodiment.
Figure 12B:
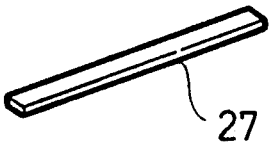
FIG. 12B is an oblique view of a rib.

FIG. 12A is a sectional view of the upper front part of another CRT picture display front. Elements in FIG. 12A corresponding to elements in FIG. 10A have the same reference numerals. In this CRT, skirt 22 and funnel 23 are made of the same material and formed as a single body. The reinforcement in FIG. 12A is a plurality of lengthwise ribs 27 welded to the inside of skirt 22. The ribs 27 are disposed parallel to the circumference of faceplate 21. FIG. 12B shows the shape of part of one of the ribs 27. Each rib 27 actually extends all the way around the circumference of faceplate 21, that is, all the way around skirt 22. Since skirt 22, the part in which tensile stress occurs, is strengthened by reinforcing ribs 27, the part is protected from implosion, furthermore, since funnel 23 is not subject to tensile stress it can be made thin, decreasing the total weight of the CRT.

Figure 13:
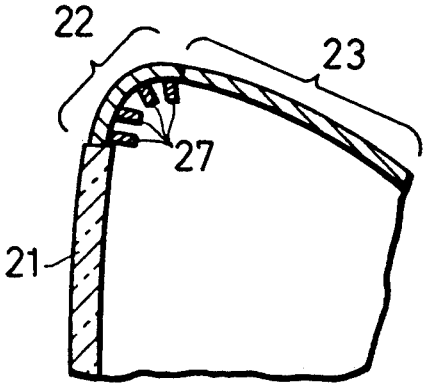
FIG. 13 is a partial sectional view of yet another form of the second embodiment.

FIG. 13 is a sectional view of the upper front part of another CRT. Elements in FIG. 13 corresponding to elements in FIG. 12A have the same reference numerals. In this CRT, skirt 22 and funnel 23 are formed separately, then welded together. Except for this difference the CRT of FIG. 13 is the same as FIG. 12A.

Figure 14:
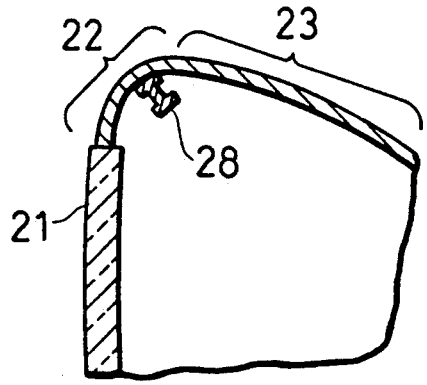
FIG. 14 is a partial sectional view of yet another form of the second embodiment.

FIG. 14 is a sectional view of the upper front part of another CRT. Elements in FIG. 14 corresponding to elements in FIG. 8A have the same reference numerals. In this CRT, skirt 22 and funnel 23 are made of the same material and formed as a single body. The reinforcement in FIG. 14 is an I-shaped member 28, welded lengthwise to the inside of skirt 22. I-shaped member 28 is disposed to the circumference of faceplate 21, running in the same direction as skirt 22. Since skirt 22, the part in which tensile stress occurs is strengthened by reinforcing member 28, the part is protected from implosion, furthermore, since funnel 23 is not subject to tensile stress it can be made thin, decreasing the total weight of the CRT. I-shaped member 28 can be structurally combined with a shadow mask (not shown in the drawing).

Figure 15:
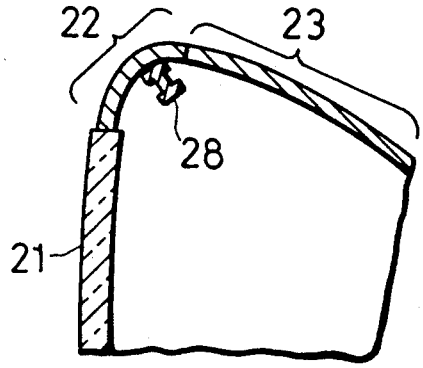
FIG. 15 is a partial sectional view of yet another form of the second embodiment.

FIG. 15 is a sectional view of the upper front part of another CRT. Elements in FIG. 15 corresponding to elements in FIG. 14 have the same reference numerals. In this CRT, skirt 22 and funnel 23 are formed separately, then welded together. Except for this difference the CRT of FIG. 15 is the same as FIG. 14.

Figure 16:
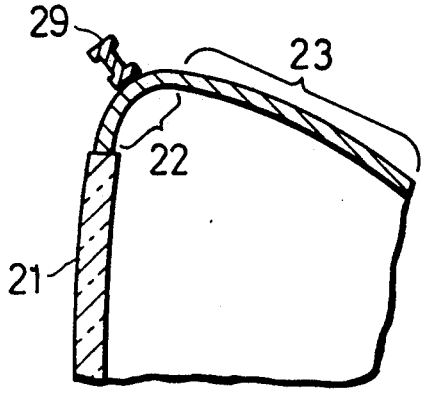
FIG. 16 is a partial sectional view of yet another form of the second embodiment.

FIG. 16 is a sectional view of the upper front part of another CRT. Elements in FIG. 16 corresponding to elements in FIG. 14 have the same reference numerals. In this CRT, skirt 22 and funnel 23 are made of the same material and formed as a single body. The reinforcement in FIG. 16 is an I-shaped member 29, welded lengthwise to the outside of skirt 22. I-shaped member 29 is disposed to the circumference of faceplate 21, running in the same direction as skirt 22. Since skirt 22, the part in which tensile stress occurs is strengthened by reinforcing member 29, the part is protected from implosion, furthermore, since funnel 23 is not subject to tensile stress it can be made thin, decreasing the total weight of the CRT. I-shaped member 29 can be structurally combined with installation bezel (not shown in the drawing).

Figure 17:
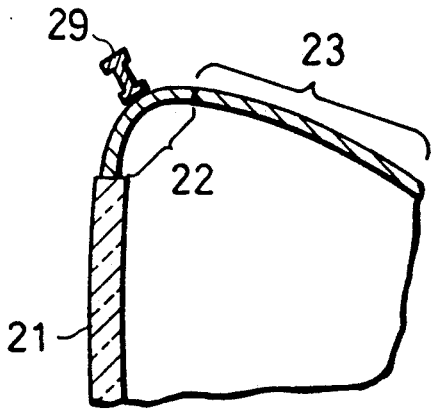
FIG. 17 is a partial sectional view of still another form of the second embodiment.

FIG. 17 is a sectional view of the upper front part of another CRT. Elements in FIG. 17 corresponding to elements in FIG. 16 have the same reference numerals. In this CRT, skirt 22 and funnel 23 are formed separately, then welded together. Except for this difference the CRT of FIG. 17 is the same as FIG. 16.

Figure 18:
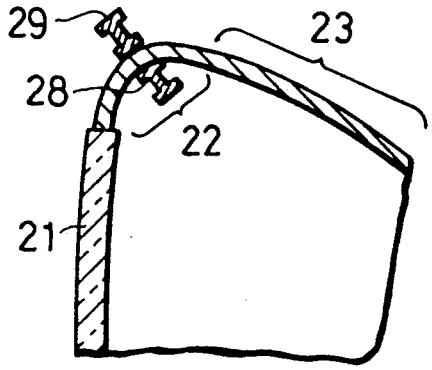
FIG. 18 is a partial sectional view of yet another form of the second embodiment.

FIG. 18 is a sectional view of the upper front part of another CRT. Elements in FIG. 18 corresponding to elements in FIGS. 13 and 15 have the same reference numerals. In this CRT, skirt 22 and funnel 23 are made of the same material and formed as a single body. The reinforcement in FIG. 18 comprises a pair of I-shaped members 28 and 29 welded one to the inside and one to the outside of skirt 22. Both I-shaped members 28 and 29 are disposed in a direction parallel to the circumference of faceplate 21. Since skirt 22, the part in which tensile stress occurs is strengthened by reinforcing members 28 and 29, the part is protected from implosion, furthermore, since funnel 23 is not subject to tensile stress it can be made thin, decreasing the total weight of the CRT.

Figure 19:
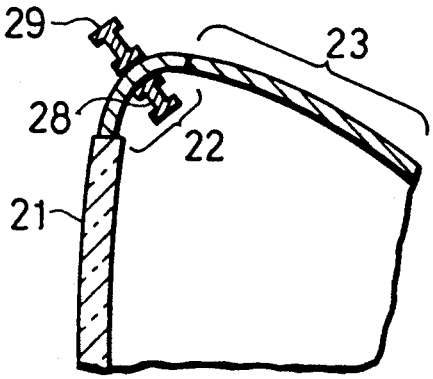
FIG. 19 is a partial sectional view of yet another form of the second embodiment.

FIG. 19 is a sectional view of the upper front part of another CRT. Elements in FIG. 19 corresponding to elements in FIG. 18 have the same reference numerals. In this CRT, skirt 22 and funnel 23 are formed separately, then welded together. Except for this difference the CRT of FIG. 19 is the same as FIG. 18.

The reinforcing members in FIGS. 14 to 19 were all I-shaped, but reinforcing members with other cross-sectional shape, such as H-shape or T-shape reinforcing members, may be used instead.

Figure 20:
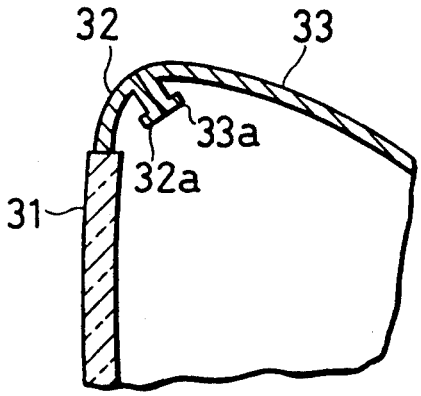
FIG. 20 is a partial sectional view of a third embodiment.

FIG. 20 shows a sectional view of the top front part of a CRT according to a third embodiment of the invention. This CRT comprises a rectangular glass faceplate 31 for picture display, a frame-shaped metal skirt 32 joined to the edge of faceplate 31, and a metal funnel 33 joined to skirt 32 and forming a side wall. Faceplate 31 and the skirt 32 are brazed together, or soldered together using frit glass. At the end distant from faceplate 31, funnel 33 terminates in a neck (not shown) containing an electron gun (not shown). The edge of skirt 32 facing funnel 33 is bent inward, forming a bent part 32*a*. The edge of funnel 33 facing skirt 32 is also bent inward, forming a bent part 33*a*. Bent part 32*a* and bent part 33*a* are welded together. In FIG. 20, tensile stress occurs around the junction between skirt 32 and funnel 33, but area is greatly strengthened by the welded bent parts 32*a* and 33*a*, so the risk of implosion is much reduced. Furthermore, since skirt 32, funnel 33, and their bend parts 32*a* and 33*a* are all thin the CRT is lightweight.

Figure 21:
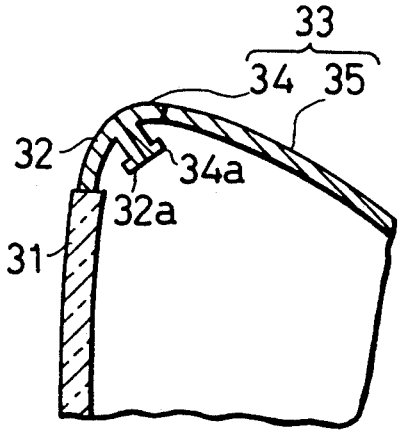
FIG. 21 is a partial sectional view of another form of the third embodiment.

FIG. 21 is a sectional view of the upper front part of another CRT. Elements in FIG. 21 corresponding to elements in FIG. 20 have the same reference numerals. Funnel 33 comprises a lip part 34 of which is bent inward to form a bent part 34*a*, and a side-wall part 35 which is welded to lip part 34. Bent part 34*a* corresponds to bent part 33*a* in FIG. 20, and is welded to the bent part 32*a* of skirt 32. Other features are the same as in FIG. 20.

Figure 22:
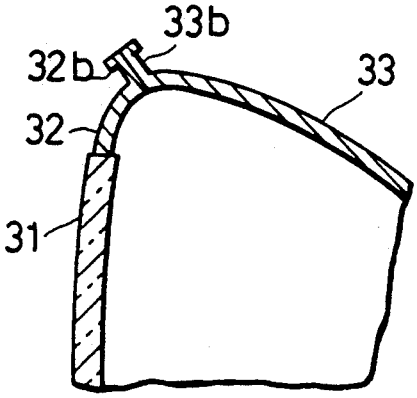
FIG. 22 is a partial sectional view of yet another form of the third embodiment.

FIG. 22 is a sectional view of the upper front part of another CRT. Elements in FIG. 22 corresponding to elements in FIG. 21 have the same reference numerals. Skirt 32 and funnel 33 have bent parts 32*b*, 33*b* which are bent outward and welded together. Otherwise, FIG. 22 is the same as FIG. 20.

Figure 23:
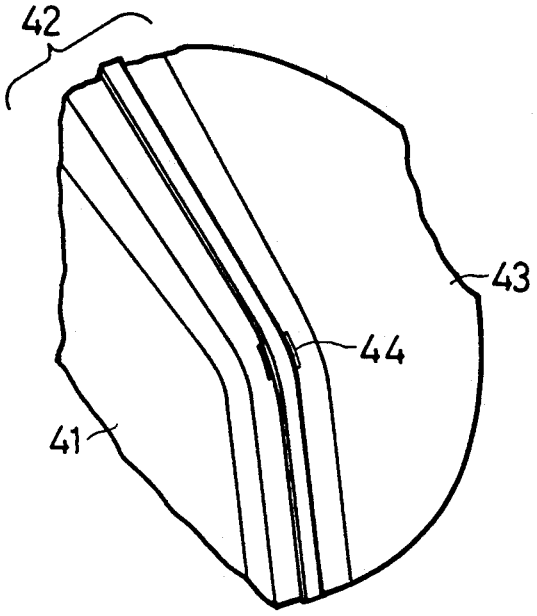
FIG. 23 is a partial sectional view of a fourth embodiment.
Figure 24:
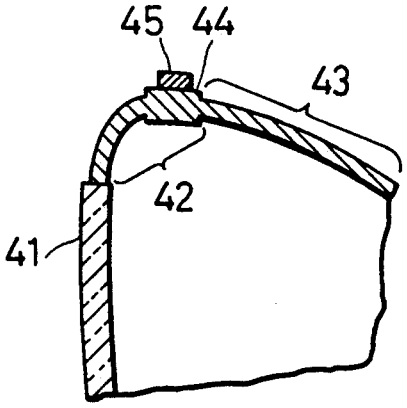
FIG. 24 is an oblique partial view of the CRT as in FIG. 23.

FIG. 23 is an oblique view of the upper part of a CRT according to a fourth embodiment. FIG. 24 shows a sectional view of the top front part of the same CRT as in FIG. 23. This CRT comprises a rectangular glass faceplate 41 for picture display, a frame-shaped metal skirt 42 joined to the edge of faceplate 41, and a metal funnel 43 joined to skirt 42 and forming a side wall. In this CRT, skirt 42 and funnel 43 are made of the same material and formed as a single body. Faceplate 41 and skirt 42 are joined by glass soldering using frit glass. Faceplate 41 is made of a glass material such as the H8602 material specified by the Electronic Industries Association of Japan. The thermal expansion coefficient of the glass faceplate 41 should be close to the thermal expansion coefficient of skirt 42 and funnel 43, which are made of a type steel such as SUS430 having a very low rate of outgassing in a vacuum. At the end distant from faceplate 41, funnel 43 terminates in a neck (not shown) containing an electron gun (not shown). As is visible in FIGS. 23 and 24 skirt part 42 has thickened corner portions 44. A tension band 45 is wound around skirt 42, passing over the thickened corner portions 44. Tensile stress is resisted by tension band 45, with the thickened corner portions 44 providing extra resistance at the points of maximum stress, so the risk of implosion is reduced. In addition, the CRT is very lightweight because only the corner portions 44 are thickened.

Figure 25:
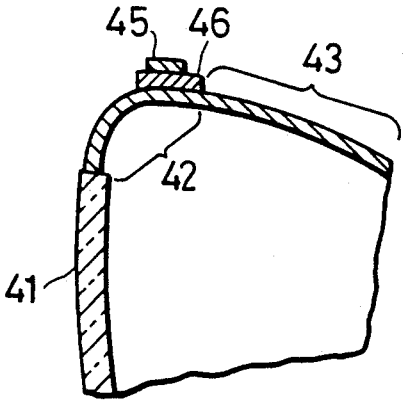
FIG. 25. is a lengthwise cross partial sectional view of another form of the fourth embodiment.

FIG. 25 is a sectional view of the upper front part of another CRT. Elements in FIG. 25 corresponding to elements in FIG. 24 have the same reference numerals. In this CRT, skirt 42 and funnel 43 are made of the same material and formed as a single body. In FIG. 25 rigid reinforcing plates 46 are welded at the four corners of skirt 42 in place of thickening the corner portions as in FIGS. 23 and 24. As is visible in FIG. 25 skirt part 42 has thickened, separately formed, corner portions 46. A tension band 45 is wound around skirt 42, passing over the thickened corner portions 46. Tensile stress is resisted by tension band 45, with the thickened corner portions 46 providing extra resistance at the points of maximum stress, so the risk of implosion is reduced. In addition, the CRT is very lightweight because only the corner portions 46 are thickened.

Figure 26:
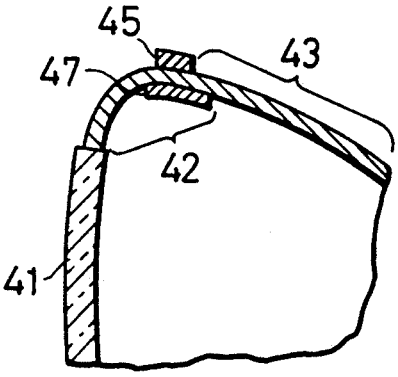
FIG. 26 is a partial sectional view of yet another form of the fourth embodiment.

FIG. 26 is a sectional view of the upper front part of another CRT picture display front. Elements in FIG. 26 corresponding to elements in FIG. 24 have the same reference numerals. In this CRT, skirt 42 and funnel 43 are made of the same material and formed as a single body. In FIG. 26 rigid reinforcing frame 47 are welded at the inside of skirt 42. Tensile stress is resisted by tension band 45, wound around the outside of skirt 42, with the reinforcing frame 47 providing extra resistance at the points of maximum stress, so the risk of implosion is reduced. In addition, the CRT is lightweight because skirt 42 and funnel 43 are formed relatively thinner.

Figure 27:
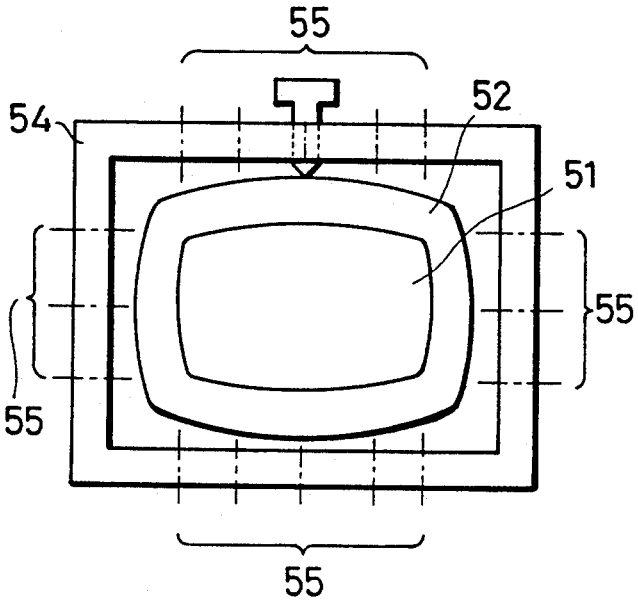
FIG. 27 is a frontal view of the fifth embodiment.
Figure 28:
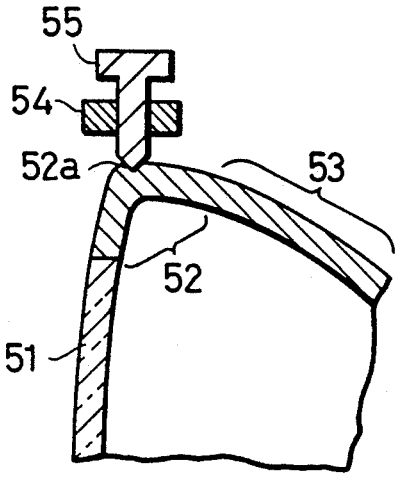
FIG. 28 is a partial sectional view of the CRT as in FIG. 27.

FIG. 27 is a frontal schematic view of a CRT according to a fifth embodiment. FIG. 28 is a sectional view of the upper front part of the CRT in FIG. 27. This CRT comprises a rectangular glass faceplate 51 for picture display, a frame-shaped metal skirt 52 joined to the edge of faceplate 51 and metal funnel 53 joined to skirt 52 and forming a side wall. In this CRT, skirt 52 and funnel 53 are made of the same material and formed as a single body. Faceplate 51 and skirt 52 are joined by glass soldering using frit glass. Faceplate 51 is made of a glass material such as the H8602 material specified by the Electronic Industries Association of Japan. The thermal expansion coefficient of the glass faceplate 51 should be close to the thermal expansion coefficient of skirt 52 and funnel 53, which are made of a type steel such as SUS430 having a very low rate of outgassing in a vacuum. At the end distant from faceplate 41, funnel 53 terminates in a neck (not shown) containing an electron gun (not shown). The skirt 52 of this CRT is encircled by the highly rigid reinforcing frame 54 provided with a plurality of compression screws 55 that press inward on skirt 52. The compression screams 55 have threads that engage threads formed in holes in frame 54. By turning the compression screws 55 it is possible to adjust the inward pressure on skirt 52. A groove 52*a* is provided in skirt 52 to receive the tips of the compression screws 55. By pressing inward on skirt 52, the compression screws 55 provide additional resistance to tensile stress, thus reducing the risk of implosion.

Figure 29:
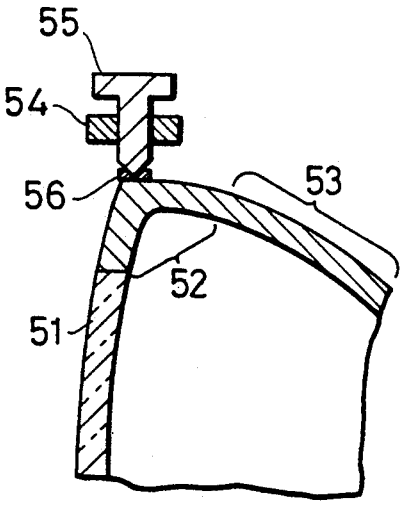
FIG. 29 is a partial sectional view of yet another form of a fifth embodiment.

FIG. 29 is a sectional view of the upper front part of another CRT. Elements in FIG. 29 corresponding to elements in FIG. 28 have the same reference numerals. In this CRT, skirt 52 and funnel 53 are made of the same material forming one body. The only difference between FIGS. 29 and 28 is an additional positioning member 56 which is attached to skirt 52 and provided with a groove to receive the tips of compression screws 55, in place of the groove 52*a* in FIG. 28.

Figure 30:
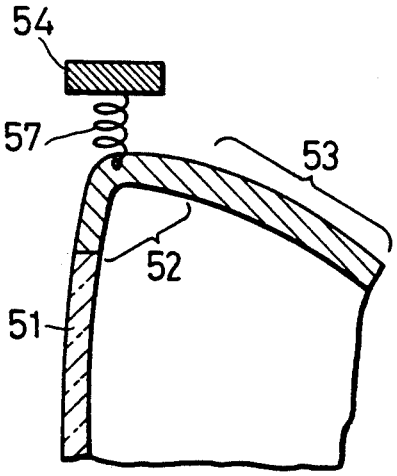
FIG. 30 is a partial sectional view of yet another form of the fifth embodiment.

FIG. 30 is a sectional view of the upper front part of another CRT. Elements in FIG. 30 corresponding to elements in FIG. 29 have the same reference numerals. The only difference from FIG. 28 is that compression springs 57 are used instead of compression screws.

What is claimed is:

1. A CRT comprising:
   - a glass faceplate forming an image display surface;
   - a frame-shaped metal skirt connected to the outer periphery of said faceplate;
   - a metal funnel having one end connected to said skirt and forming a side wall;
   - a neck connected to another end of said funnel; and
   - an electron gun disposed in said neck facing said faceplate;
   - wherein said skirt is thicker than said funnel and at least part of said skirt extends longitudinally from said faceplate in the same direction of the curvature of said faceplate.

2. The CRT of claim 1, wherein said skirt and said funnel are made of the same material and formed as a single body.

3. The CRT of claim 1, wherein said skirt and said funnel are made separately and welded together.

4. The CRT of claim 1, wherein said skirt is everywhere thicker than said funnel.

5. The CRT of claim 1, wherein only corners of said skirt are thicker than said funnel.

6. The CRT of claim 1, wherein said skirt has a substantially L-shaped cross section.

7. The CRT of claim 1, wherein said faceplate and said skirt are joined by soldering with frit glass.

8. The CRT of claim 1, wherein said faceplate and said skirt are joined by brazing.

9. A CRT comprising:

a glass faceplate forming an image display surface;
a frame shaped metal skirt connected to the outer periphery of the faceplate;
a metal funnel having one end connected to said skirt and forming a side wall;
a neck connected to another end of said funnel;
an electron gun disposed in said neck facing said faceplate; and
a rigid reinforcing member attached to said skirt wherein said reinforcing member is welded to an interior surface of said skirt.

10. The CRT of claim 9, wherein said skirt and said funnel are made of the same material and formed as a single body.

11. The CRT of claim 9, wherein said skirt and said faceplate are made separately and welded together.

12. The CRT of claim 9, wherein said faceplate and said skirt are joined by soldering with frit glass.

13. The CRT of claim 9, wherein said faceplate and said skirt are joined by brazing.

14. The CRT of claim 9, wherein said reinforcing member has an I-shaped cross section.

15. A CRT comprising:
a glass faceplate forming an image display surface;
a frame shaped metal skirt connected to the outer periphery of the faceplate;
a metal funnel having one end connected to said skirt and forming a side wall;
a neck connected to another end of said funnel;
an electron gun disposed in said neck facing said faceplate; and
a rigid reinforcing member attached to said skirt wherein said reinforcing member comprises a plurality of ribs welded to an interior surface of said skirt.

16. The CRT of claim 15, wherein said ribs are disposed crosswise on said skirt, orthogonal to the circumference of said faceplate.

17. The CRT of claim 15, wherein said ribs are disposed lengthwise on said skirt, parallel to the circumference of said faceplate.

18. A CRT comprising:
a glass faceplate forming an image display surface;
a frame shaped metal skirt connected to the outer periphery of the faceplate;
a metal funnel having one end connected to said skirt and forming a side wall;
a neck connected to another end of said funnel;
an electron gun disposed in said neck facing said faceplate; and
a rigid reinforcing member attached to said skirt wherein said reinforcing member has an I-shaped cross section.

19. A CRT comprising:
a glass faceplate forming an image display surface;
a frame shaped metal skirt connected to the outer periphery of the faceplate;
a metal funnel having one end connected to said skirt and forming a side wall;
a neck connected to another end of said funnel;
an electron gun disposed in said neck facing said faceplate; and
a rigid reinforcing member attached to said skirt wherein said reinforcing member is welded to an exterior surface of said skirt and has an I-shaped cross section.

20. A CRT comprising:
a glass faceplate forming an image display surface;
a frame shaped metal skirt connected to the outer periphery of the faceplate;
a metal funnel having one end connected to said skirt and forming a side wall;
a neck connected to another end of said funnel;
an electron gun disposed in said neck facing said faceplate; and
a rigid reinforcing member attached to said skirt wherein said reinforcing members are welded to both interior and exterior surfaces of said skirt.

21. The CRT of claim 20, wherein said reinforcing members have an I-shaped cross section.

22. A CRT comprising:
a glass faceplate forming an image display surface;
a frame-shaped metal skirt connected to the outer periphery of the faceplate;
a metal funnel having one end connected to said skirt and forming a side wall;
a neck connected to another end of said funnel; and
an electron gun disposed in said neck facing said faceplate;
wherein at least part of said skirt extends longitudinally from said faceplate in the same direction of the curvature of said faceplate; and
wherein said skirt has a bent part, and said funnel has a bent part, and the bent part of said skirt is welded to the bent part of said funnel.

23. The CRT of claim 22, wherein the bent part of said skirt and the bent part of said funnel are bent inwards.

24. The CRT of claim 22, wherein the bent part of said skirt and the bent part of said funnel are bent outwards.

25. The CRT of claim 22, wherein the bent part of said skirt and the bent part of said funnel extend in the same direction and each bent part has a surface facing each other, and the surfaces of each bent part are connected to each other.

26. A CRT comprising:
a glass faceplate forming an image display surface;
a frame-shaped metal skirt connected to the outer periphery of said faceplate the corners of the skirt being thicker than the rest of the skirt;
a metal funnel having one end connected to said skirt and forming a side wall;
a neck connected to another end of said funnel;
an electron gun disposed in said neck facing said faceplate; and
an annular tension band wound around said skirt.

27. A CRT comprising:
a glass faceplate forming an image display surface;
a frame-shaped metal skirt connected to the outer periphery of said faceplate;
a metal funnel having one end connected to said skirt and forming a side wall;
a neck connected to another end of said funnel;
an electron gun disposed in said neck facing said faceplate;
rigid reinforcing plates welded to corners of said skirt; and
a tension band wound around said skirt.

28. The CRT of claim 27, wherein said rigid reinforcing plates are welded to the exterior surface of said skirt, and said tension band is disposed in contact with said rigid reinforcing plates.

29. The CRT of claim 27, wherein said rigid reinforcing plates are connected to the interior surface of said skirt.

30. A CRT comprising:

a glass faceplate forming an image display surface;

a frame-shaped metal skirt connected to the outer periphery of the faceplate;

a metal funnel having one end connected to said skirt forming a side wall;

a neck connected to another end of said funnel;

an electron gun disposed in said neck facing said faceplate;

a rigid reinforcing frame having four corners surrounding said skirt; and a plurality of compression members attached to said rigid reinforcing frame between adjacent pairs of two of said four corners and pressing inward on said skirt.

31. The CRT of claim 30, wherein said compression members are screws that can be adjusted by turning in holes in said rigid reinforcing frame.

32. A CRT comprising:

a glass faceplate forming an image display surface;

a frame-shaped metal skirt connected to the outer periphery of the faceplate;

a metal funnel having one end connected to said skirt forming a side wall;

a neck connected to another end of said funnel;

an electron gun disposed in said neck facing said faceplate;

a rigid reinforcing frame surrounding said skirt; and a plurality of compression members attached to said rigid reinforcing frame and pressing inward on said skirt wherein said compression members are springs attached to said reinforcing frame at one end and to said skirt at another end.

33. A CRT comprising:

a glass faceplate forming an image display surface;

a frame-shaped metal skirt connected to the outer periphery of the faceplate;

a metal funnel having one end connected to said skirt forming a side wall;

a neck connected to another end of said funnel;

an electron gun disposed in said neck facing said faceplate;

a rigid reinforcing frame surrounding said skirt; and a plurality of compression members attached to said rigid reinforcing frame and pressing inward on said skirt wherein said skirt has a groove for receiving tips of said compression members.

* * * * *